US006305113B1

(12) United States Patent
Calvete

(10) Patent No.: US 6,305,113 B1
(45) Date of Patent: Oct. 23, 2001

(54) MUZZLE-LOADING RIFLE WITH A SIDE NIPPLE ASSEMBLY AND TAKEDOWN BREECH

(75) Inventor: Angel Calvete, Zamudio-Bilbao (ES)

(73) Assignee: Ardesa, S.A., Zamudio-Bilbao (ES)

( * ) Notice: Subject to any disclaimer, the term of this patent is extended or adjusted under 35 U.S.C. 154(b) by 0 days.

(21) Appl. No.: 09/238,843

(22) Filed: Jan. 28, 1999

(51) Int. Cl.[7] ..... F41A 19/00; F41A 17/28; F41C 9/08

(52) U.S. Cl. ..... 42/51; 42/41; 42/69.01; 42/70.05; 42/75.01; 42/75.02; 42/83

(58) Field of Search ..... 42/51, 83, 69.01, 42/41, 70.04, 70.05, 75.01, 75.02

(56) References Cited

U.S. PATENT DOCUMENTS

| | | | | |
|---|---|---|---|---|
| 1,106 | * | 3/1839 | Butterfield | 42/51 |
| 59,706 | * | 11/1866 | Bourdereaux | 42/69.01 |
| 230,693 | * | 8/1880 | Daggett | 42/83 |
| 3,451,154 | * | 6/1969 | Goble | 42/51 |
| 3,577,667 | * | 5/1971 | Kern et al. | 42/51 |
| 4,114,303 | * | 9/1978 | Vaughn | 42/51 |
| 4,158,926 | * | 6/1979 | Kordas, Jr. et al. | 42/69.01 |
| 4,186,506 | * | 2/1980 | Pawlak et al. | 42/83 |
| 4,468,877 | * | 9/1984 | Karvonen | 42/51 |
| 4,519,156 | * | 5/1985 | Shaw | 42/51 |
| 4,989,357 | * | 2/1991 | Norman et al. | 42/51 |
| 5,133,143 | * | 7/1992 | Knight | 42/51 |
| 5,606,817 | * | 3/1997 | Sachse | 42/51 |
| 5,623,779 | * | 4/1997 | Rainey, III | 42/51 |
| 5,632,109 | * | 5/1997 | Caudle | 42/51 |
| 5,718,073 | * | 2/1998 | Sachse et al. | 42/51 |
| 6,219,951 | * | 4/2001 | Cate | 42/51 |
| 6,223,459 | * | 5/2001 | Hengstenberg | 42/51 |

* cited by examiner

*Primary Examiner*—Darren W. Ark
(74) *Attorney, Agent, or Firm*—Helfgott & Karas, P.C.

(57) ABSTRACT

The barrel (2) and the breech (8) are coaxially screw mounted within a tubular casing (9), and therefore said casing (9) not only stands as an interconnection between these elements, but reinforces the same substantially, allowing the use of more tilan one gunpowder pellet (16), a throttling (13) being established between the two casing (9) are at which the nipple assembly (15) is located on said casing, being thus laterally arranged. The rifle may thus, with the classic lateral nipple assembly, be easily taken down to be cleaned. lt is moreover fitted with an additional safety (36) which allows the cocked position with safety to be fall silently changed to the cocked position without safety, which is particularly appropriate when the rifle is used as a hunting weapon.

15 Claims, 13 Drawing Sheets

I-J

A-B

C-D

E-F

G-H

I-J

I-J

I-J

I-J

MUZZLE-LOADING RIFLE WITH A SIDE NIPPLE ASSEMBLY AND TAKEDOWN BREECH

OBJECT OF THE INVENTION

The present invention relates to a muzzle-loading rifle having a laterally arranged nipple assembly, as classic muzzle-loading rifles do, and a takedown breech for the firearm to be easily cleaned.

The rifle has been specifically devised to be used as a hunting weapon and, in this sense, in addition to allowing the barrel and breech to be taken down for an easier cleaning, an additional safety system is fitted which is very silently activated, in order for sucb activation not to be perceived by the game.

BACKGROUND OF THE INVENTION

Classic muzzle-loading rifles are known to have a side nipple assembly and a fixed breech, and are therefore cleaned without taking the firearm down, using a rod that is inserted through the mouth of the barrel.

These classic muzzle-loading rifles began to be reproduced in recent times, endeavouring to faithfully reproduce the original firearm, albeit incorporating new details provided by the new technologies, as concerns materials, accessories, constructional systems, etc.

In recent years, muzzle-loading rifles have been marketed with the striker in line with the breech and barrel, which striker originally consisted of a mass which struck, as a bolt, against the breech.

These new muzzle-loading rifles, so-called in-line rifles, were convenient in that the barrel and breech could be taken down to be cleaned.

More recently, muzzle-loading rifles, which are similarly of the in-line type, have emerged in which the bolt looks like and indeed works essentially as modem rifle bolts, such as the Spanish "Mauser" or those described in U.S. Pat. Nos. 5,606,817 and 5,718,073.

These in-line muzzle-loading rifles have moreover been fitted with elements peculiar to modem arms, such as ranges, telescopic sights, etc., to such an extent that their resemblance with the original or classic muzzle-loading firearms is almost non-existent, not only as to the outward appearance but also as to their effectiveness and results.

There is however a large sector of consumers, as with hunters in given countries, particularly in the United States, where muzzle-loading firearms are used for hunting during a certain time of the year, or in certain places or areas, who would like their firearm to be an accurate as possible a classic muzzle-loading rifle, particularly with the nipple assembly laterally arranged as in the laiter rifles.

Furthermore, muzzle-loading rifles are fitted with a firing system in which a hammer is provided, mounted on a cam pushed by a shuttle upon firing, the cam working with a safety which may fit in a housing in the cam to define a safety position matching the cocked position of the hammer, at the same time as a spring keeps the safety proper in a safety or firing position.

When changing from the safety to the firing position, a click sounds which, when the rifle is used as a huting weapon, may be heard or perceived by the game, causing them to run off, which results in many hunters carrying their firearm in the firing position with the ensuing likelihood of accidents.

DESCRIPTION OF THE INVENTION

The muzzle-loading rifle disclosed herein has been devised and structured in order to fully solve the two sides of the drawbacks set forth above, i.e. in order to enable the same to be easily taken down to be regularly cleaned, in spite of having a side nipple assembly, as with classic muzzle-loading rifles, and in order to include a safety system enabling the firing position to be silently changed to.

More specifically, and in order to achieve the above, the rifle is fitted, in accordance with the characteristics of the invention, between the classic barrel and breech, an intermediate casing that fulfils a double purpose, namely on the one hand serving as a means for coupling the barrel and breech in line, which members may therefore be easily assembled and taken down in order for the firearm to be cleaned and maintained, and on the other hand substantially reinforcing the area of the nipple assembly, thereby for the rifle to be able to work with two or more gunpowder pellets, limited only to the recoil effect the user is able to withstand on his or her shoulder.

In order to complement the above, said casing is provided with a throttling at its midpoint, separating the breech from the barrel and standing as the area in which the nipple assembly is established, and is thus laterally arranged.

This throttling of the casing can be achieved by means of an independent part, specifically by means of a washer coaxially arranged between the barrel and the breech and fixed by these elements upon the same being screwed to the casing.

This "breech-casing-barrel" assembly is mounted on the firearm stock through a rear shank, provided with a front through bore whose shape and size matches the breech area projecting from the casing, which it is to receive snugly, moreover provided with a rear arm which it is duly embedded in the stock and is in turn provided with a bore that allows the relevant fixing screw through, fixing being complemented with a fastener fixing the barrel directly to the front end of the stock.

To complement the above structure, the shank is provided with a small front projection that fits in a slot in the breech, acting as a key defining the exact position to be taken up by the assembly upon being assembled.

In accordance with another of the characteristics of the invention, the rifle is provided with an additional safety, which could be called rib safety, and which allows the firearm to be carried in the firing position. This additional safety comprises a rib or lever attached to a cross shaft ending in a semicylindrical sector, defining an end support for the safety, and therefore when the safety is disengaged through its other end from the conventional safely, it comes to lie on this semicylindrical element, whereupon the firearm will be cocked and in the firing position, although firing will not be possible since the safety is held still by the additional safety. Upon firing, pivoting of the rib or lever causes the semicylindrical end to turn, thereby for the latter to cease being a cam stop and the cam may pivot upon pulling the firing trigger. Obviously, the said rib or lever of the additional safety may be full silently driven.

Finally, and in accordance with another of the characteristics of the invention, a small change can be made in the firing system cam, consisting of a small mobile part pivoting on a shaft, controlled by a small spring, the purpose of which part is to be able to have the safety arranged in the cam safety position and simultaneously the rear rib or lever safety, i.e. to allow both safeties to take up a working position at the same time In accordance with this construction, if the hammer is cocked in the fixing position, without disengaging the lever safety, this mobile part or cog retracts to allow the safety through. When the firing position is surpassed, the cog, driven by the spring, lies in a cocked position, the cam being cocked in the firing position.

DESCRIPTION OF THE DRAWINGS

In order to provide a fuller description and contribute to the complete understanding of the characteristics of this invention, in accordance with a preferred practical embodiment thereof, a set of drawings is attached to the specification as an integral part thereof which, while purely illustrative and not fully comprehensive, shows the following.

PREFERRED EMBODIMENT OF THE INVENTION

Figure 1:
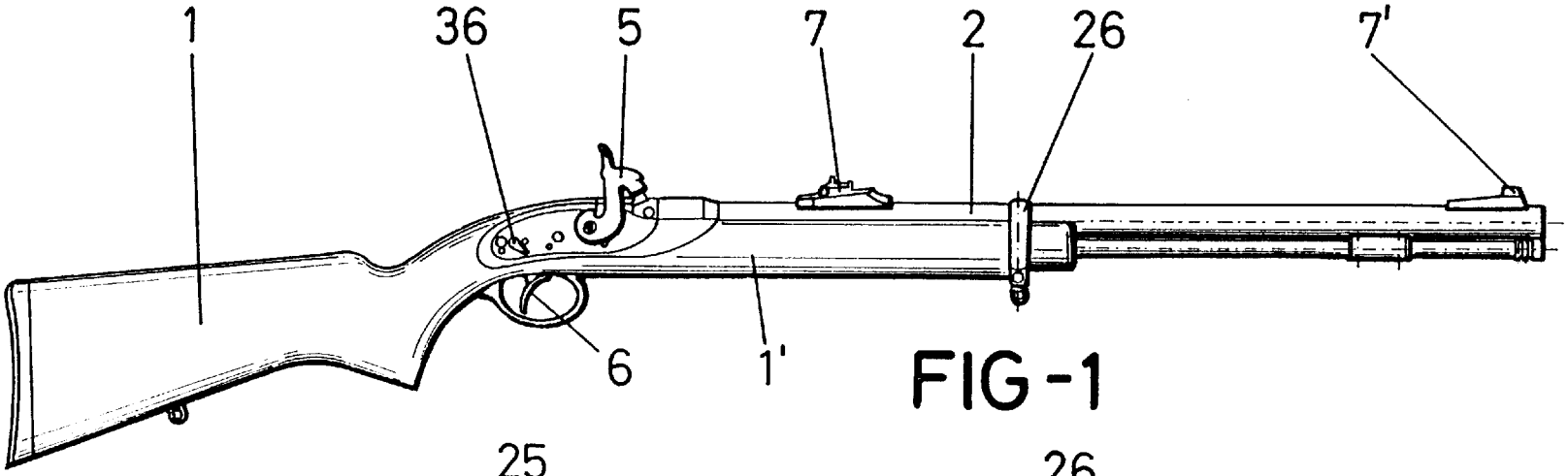
FIG. 1.—Is a schematic side elevation representation of a muzzle-loading rifle with a side nipple assembly and take-down breech made in accordance with the object of the present invention.
Figure 2:
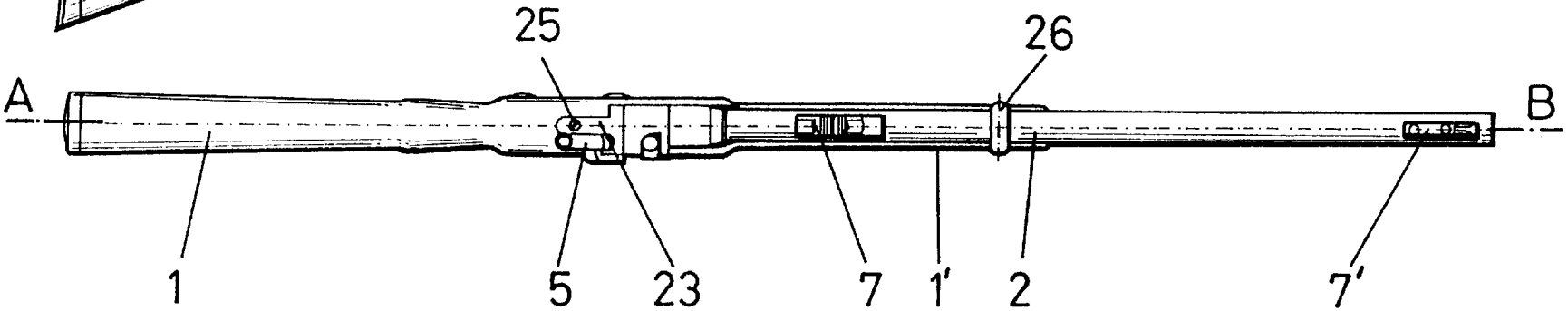
FIG. 2.—Is a plan view of the same rifle.

With reference to the above figures and specifically FIGS. 1 to 4, the muzzle-loading rifle disclosed in the invention is structured, as any conventional rifle of this kind, with a stock (1) provided with a large front extension (1') constituting the barrel (2) "bed" or mount, which stock has a side housing for the firing and safety mechanism (3) which is concealed by a side plate (4) in which the hammer (5), driven by a classic trigger (6), is established, the barrel (2) being fitted with the mechanisms (7–7') making up the likewise classic sight.

Figure 7:
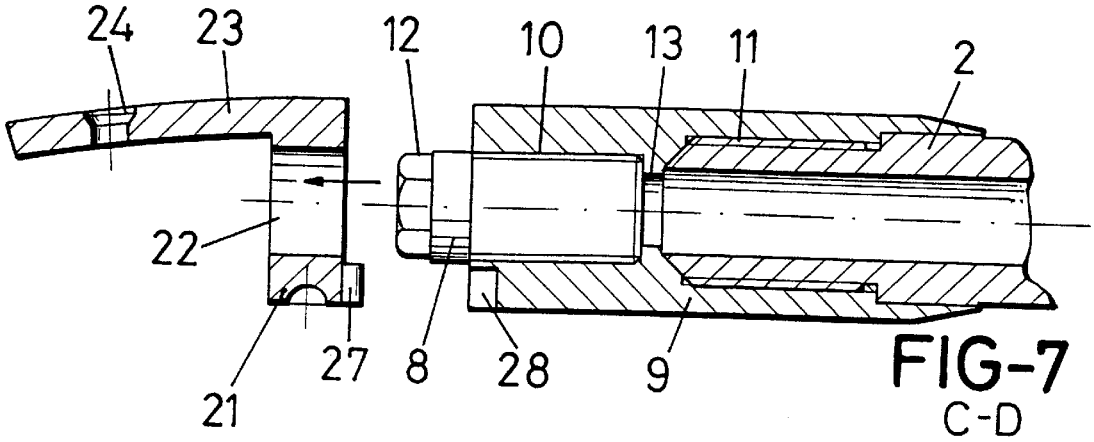
FIG. 7.—Is a side elevation and longitudinal sectional view of the same assembly of FIGS. 5 and 6, along line C–D of FIG. 5.

Moving now into the invention, the barrel (2) is coaxially coupled to the breech (8) with the assistance of a casing (9), whose structure is specifically shown in FIG. 7, which casing is provided with two coaxial threaded sectors (10) and (11), the first being a rear sector designed for fixing the breech (8), which is fitted and taken down with the assistance of a suitable wrench acting on a polygonal head (12) thereof, whereas the barrel (2) can be fitted and taken down by manual action, turning it in the appropriate direction of rotation.

Figure 3:
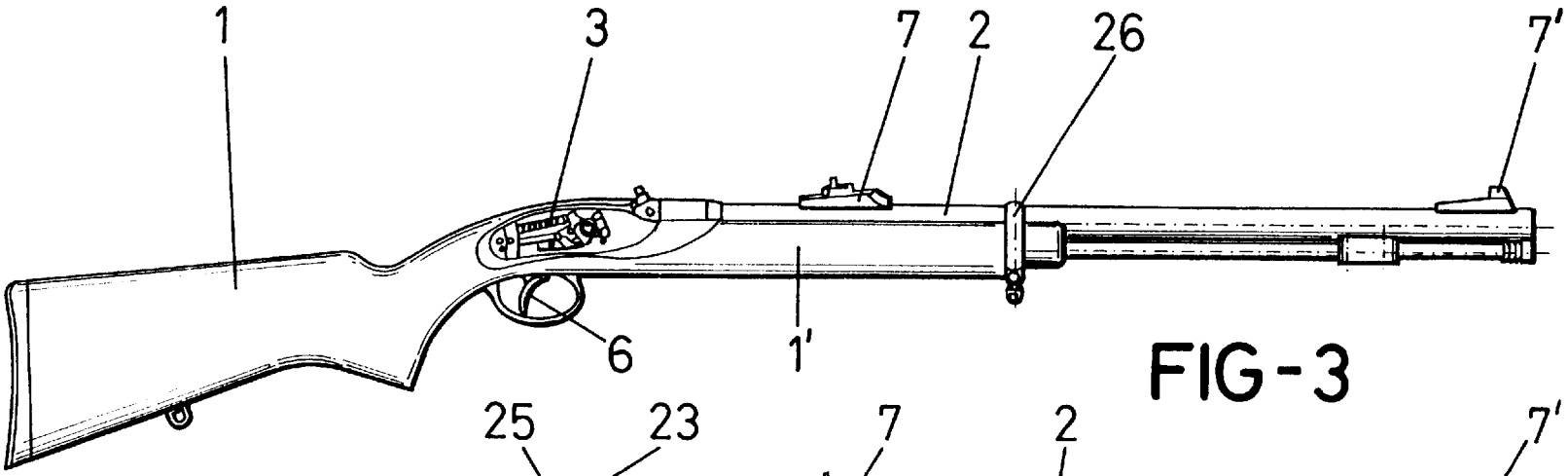
FIG. 3.—Is another side elevation view of the rifle with the plate supporting the hammer removed in order to show the firing and safety system.
Figure 8:
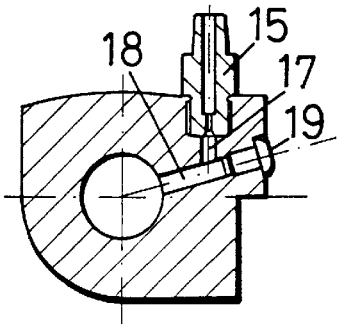
FIG. 8.—Is a cross-sectional close view at the nipple assembly, along line E–F of FIG. 6.
Figure 9:
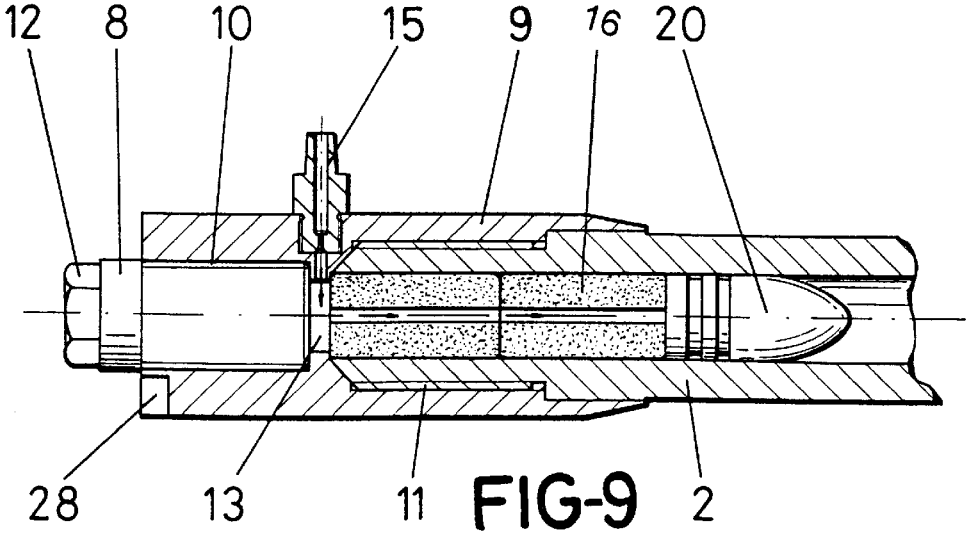
FIG. 9.—Is a sectional close view similar to that of FIG. 7, in this case without the shank, the casing including the nipple assembly and the barrel being shown with a projectile and two gunpowder pellets.
Figure 10:
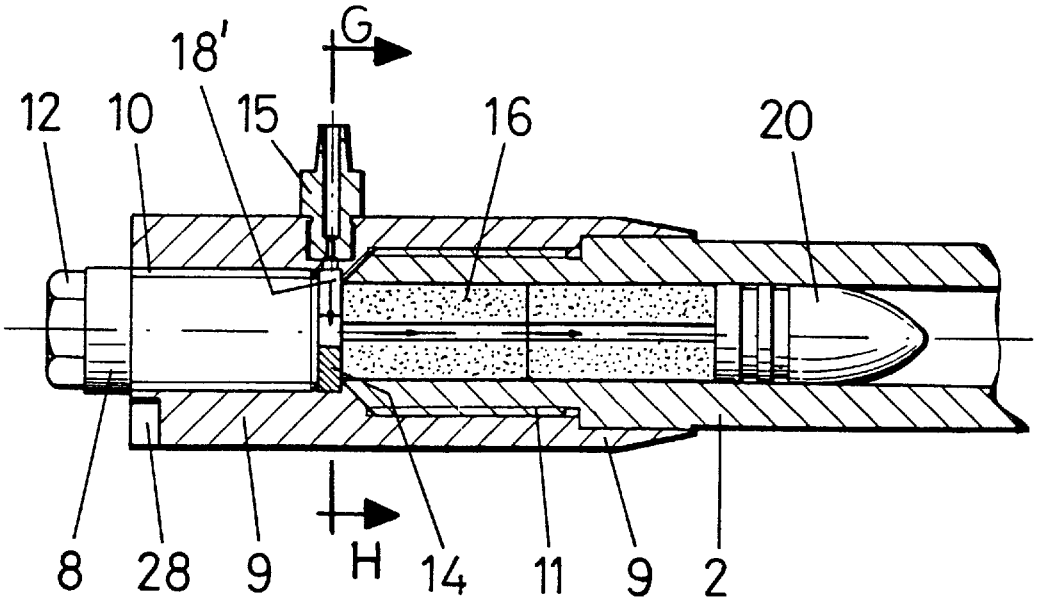
FIG. 10.—Is a section similar to that of FIG. 9, albeit with the throttling of the casing separating the breech portion from the barrel portion defined by a washer.
Figure 11:
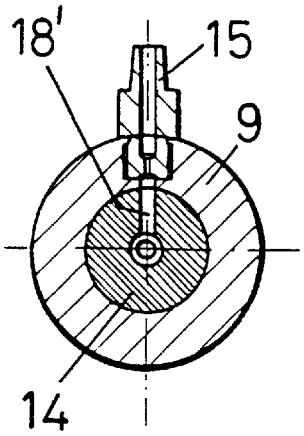
FIG. 11.—Is a cross-sectional close view of the assembly shown in the preceding figure, along line G–H of said figure, specifically at the said washer.
Figure 12:
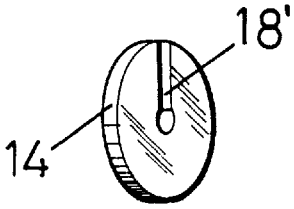
FIG. 12.—Is a perspective close view of the aforesaid washer.

The axial housing of the casing (9) is provided with an intermediate throttling (13) constituting a stop limiting the insertion of both the barrel (2) and the breech (8), and may be made of the same material as the casing (9), as in the practical embodiment shown in FIG. 8, or may be obtained with the assistance of an auxiliary washer (14) as in the practical embodiment shown in FIG. 10, this narrowed portion (13) in any event being the location of the combustion system comprising a nipple (15) which, specifically with reference to the section of FIG. 8, is laterally arranged, suiting the position of the hammer (5), and leads into the gunpowder pellets (16) through a bore (17) which is also laterally provided and a radial bore (18) which, as appropriate, comprises a radial slot (18') in the washer (14) and which is closed by a plug (19) in the first case, said bore (18) or slot (19) in any event leading into the housing of the pellets (16) within the barrel (2), the projectile (20) being positioned in front of said pellet or pellets (16), as shown in FIGS. 3 and 8.

The barrel (2) and the breech (8) may thus be coupled in line and may be easily taken down, and the nipple assembly is in turn laterally arranged, as with classic or original muzzle-loading rifles, the casing (9) at the same time considerably reinforcing the explosion area of the firearm, allowing more than one pellet (16) of gunpowder to be used to improve the range of the projectile (20).

Figure 4:
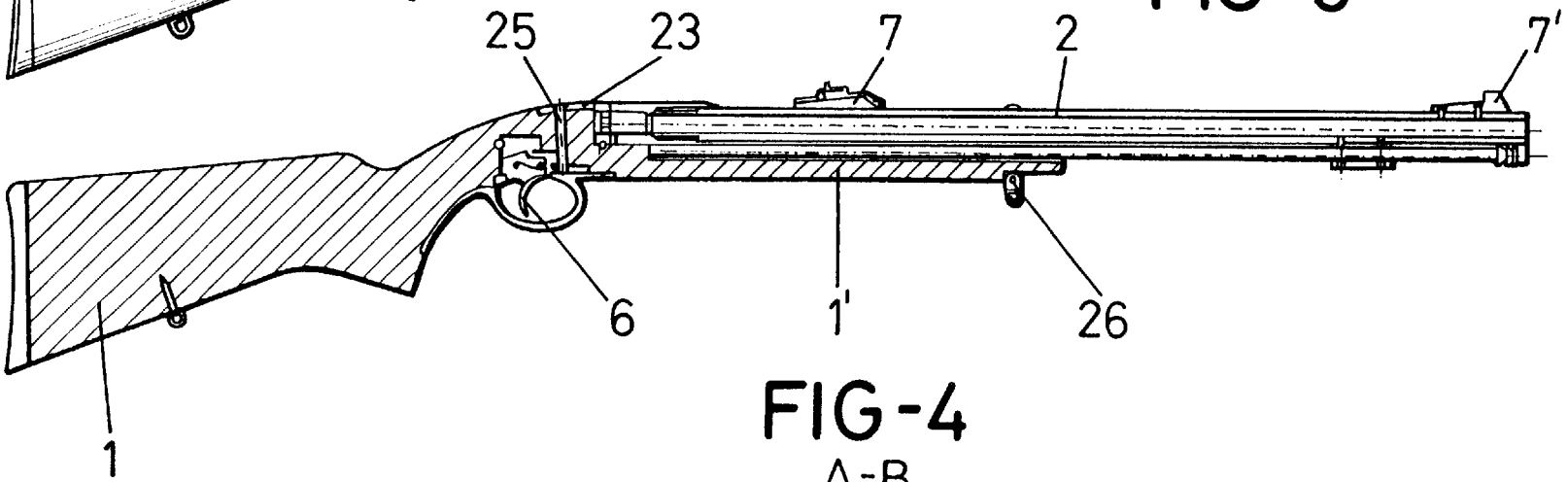
FIG. 4.—Is a longitudinal section of the rifle along line A–B of FIG. 2.
Figure 5:
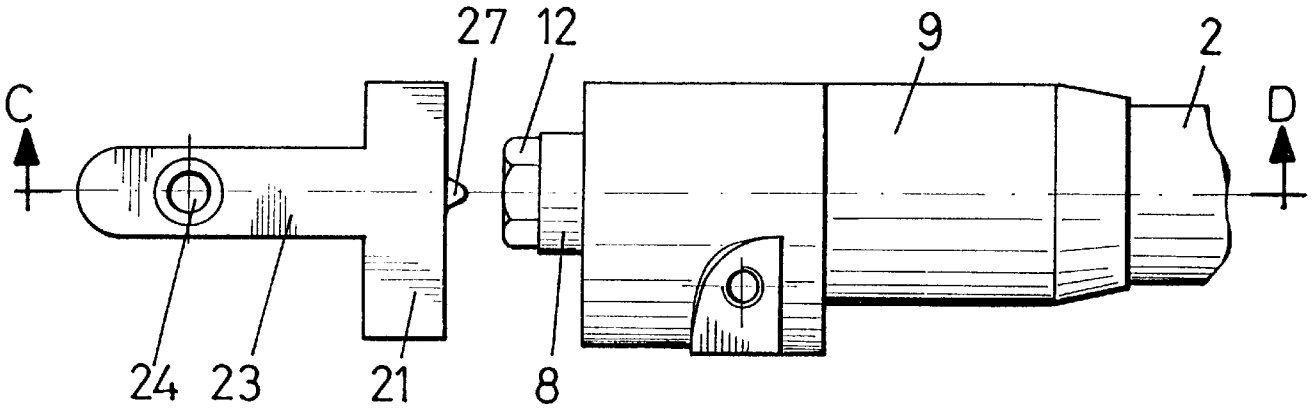
FIG. 5.—Is an enlarged close plan view of the casing, breech and barrel assembly, which barrel is shown only at the starting end, and of the fixing shank, which is shown taken down.
Figure 6:
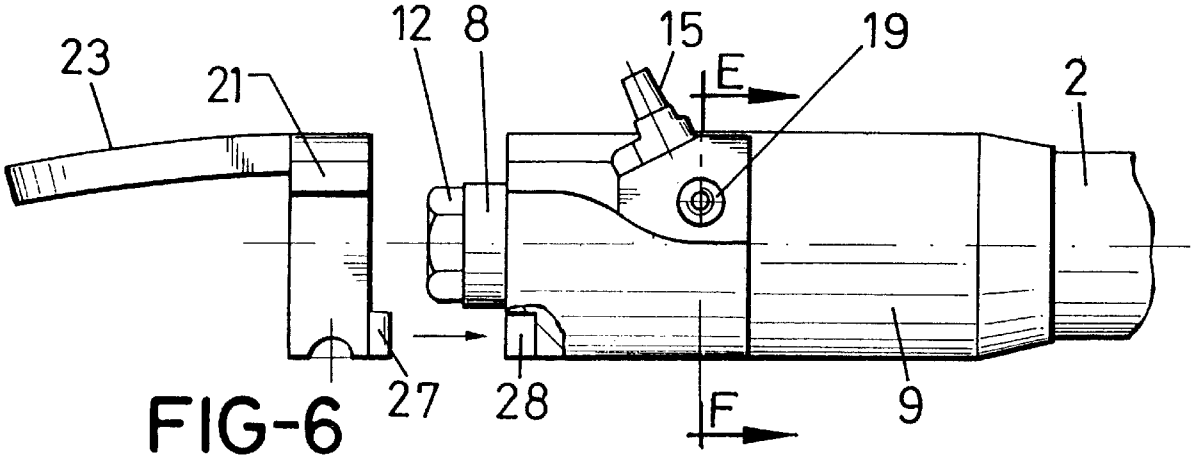
FIG. 6.—Is a side elevation view of the same assembly of the preceding figure.

This barrel (2)—breech (8)—casing (9) assembly is fixed to the stock (1) with the assistance of a shank (21) provided with a bore (22) whose shape and size is appropriate for snugly receiving within it the breech (8) sector projecting from the casing (9) after being fitted to the latter, said shank (21) extending into an arm (23) designed to be inserted in the top face of the stock (2) and provided with a bore (24) to allow a screw (25) fixing the shank to the stock through, as is especially shown FIG. 4, fixing of this assembly to the stock being completed with the assistance of a fastener (26) which simultaneously fastens the barrel (2) and the free end of the front sector (1') of the stock, this time with reference particularly to FIG. 1.

The shank (21) is also provided with a small projection (27) facing the casing (9) which is complemented by a slot (28) in said casing (9), which elements, namely the projection (27) and the slot (28) act as a key defining the exact position that the casing (9) must take up with respect to the shank (21) upon these elements being assembled.

Figure 13:
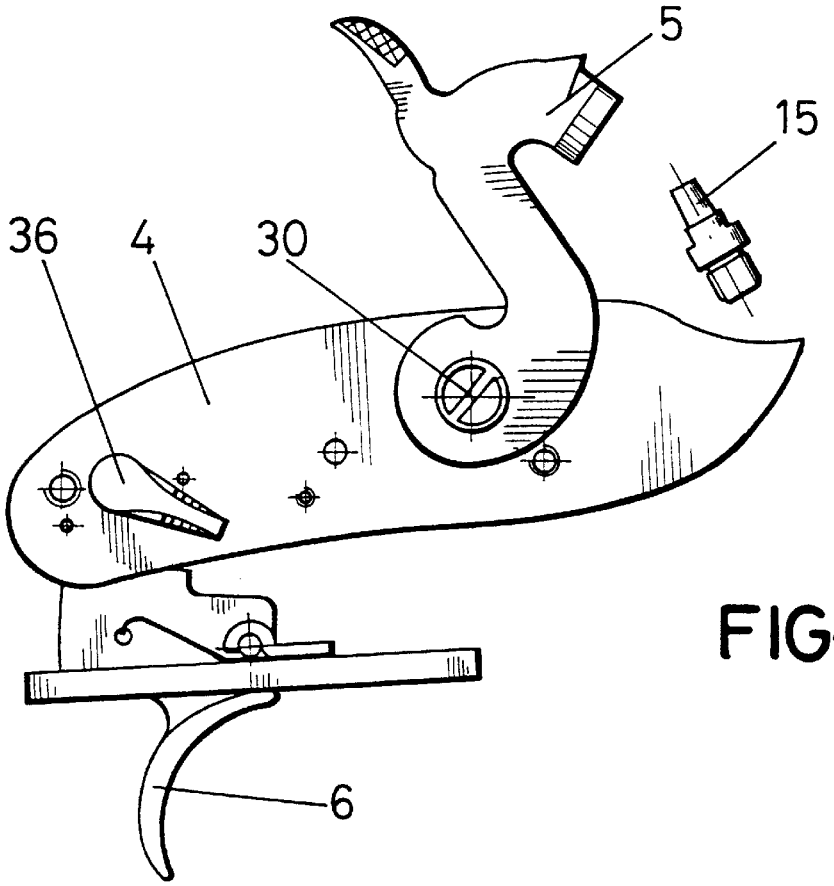
FIG. 13.—Is a side elevation view of the plate supporting Be haunmer and the additional safety lever, at the "half-safety position".
Figure 14:
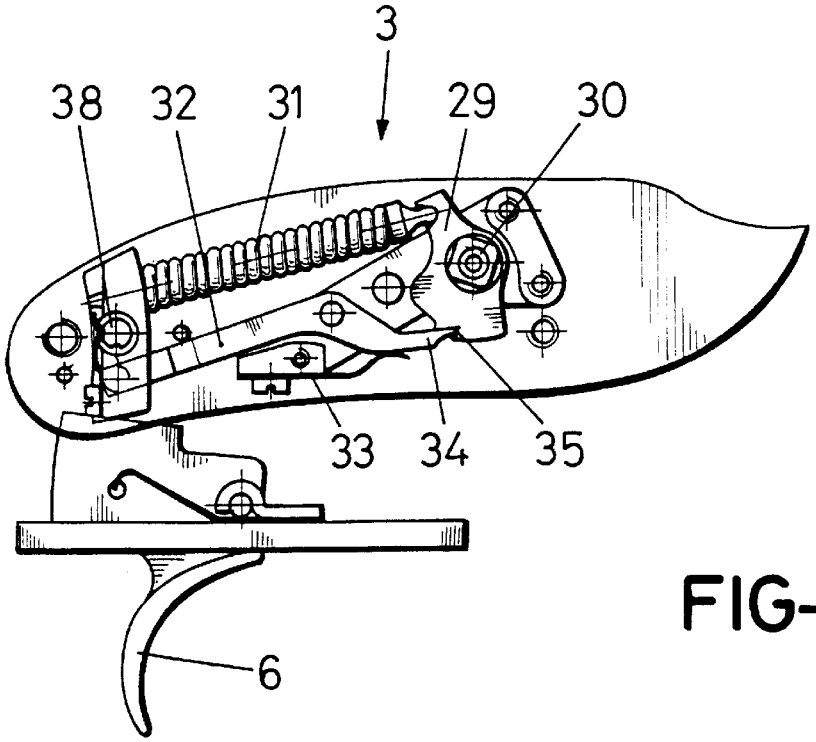
FIG. 14.—Is the firing and safety system established behind the plate of the preceding figure, in the same position aforesaid.

Moving on now to the firing and safety mechanism (3), this mechanism is provided with a cam (29) to which a classic hammer (5) is in tino attached through its pivoting shaft (30), which cam (29) is pushed by a shuttle (31) at the time of firing, and works with a safety (32) assisted by a safety spring (33), and therefore the end (34) of the safety (32) can fit in a housing (35) of the cam to define a safety position coinciding with the cocked position, which so-called "half-safety position" shown in FIGS. 13 and 14. The change from a safety position to the firing position, as aforesaid, produces a click sound which may be heard or perceived by the game, causing them to run off, when the rifle is used as a hunting weapon.

Figure 15:
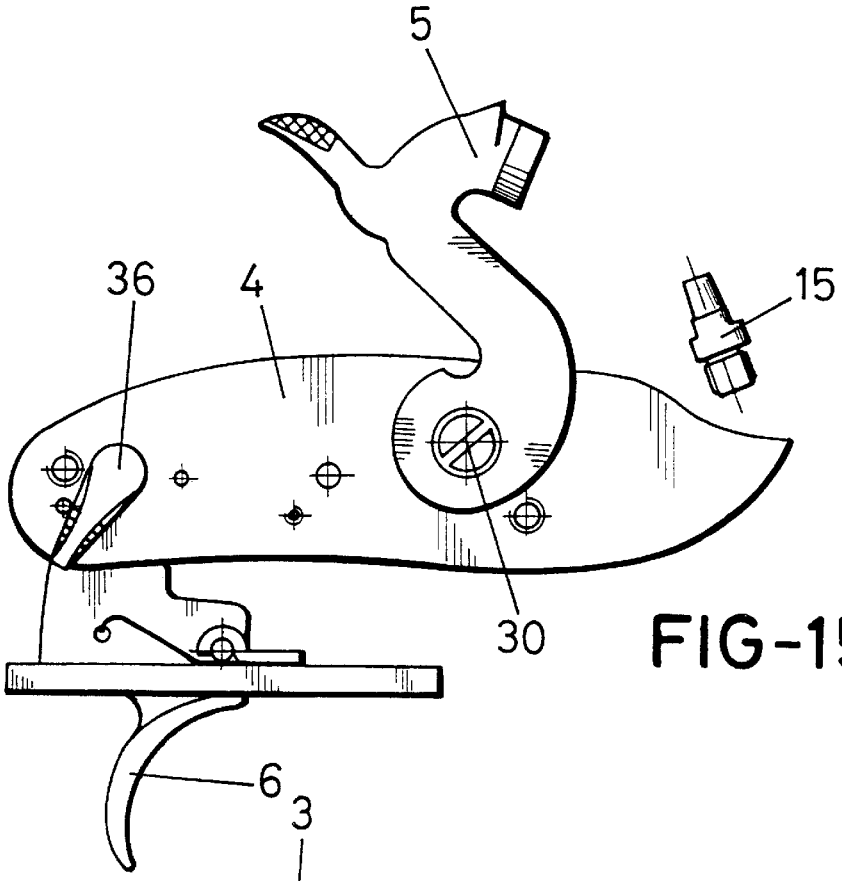
FIGS. 15 and 16.—Are views similar to those of FIGS. 13 and 14, in the "cocked with safety" position.
Figure 16:
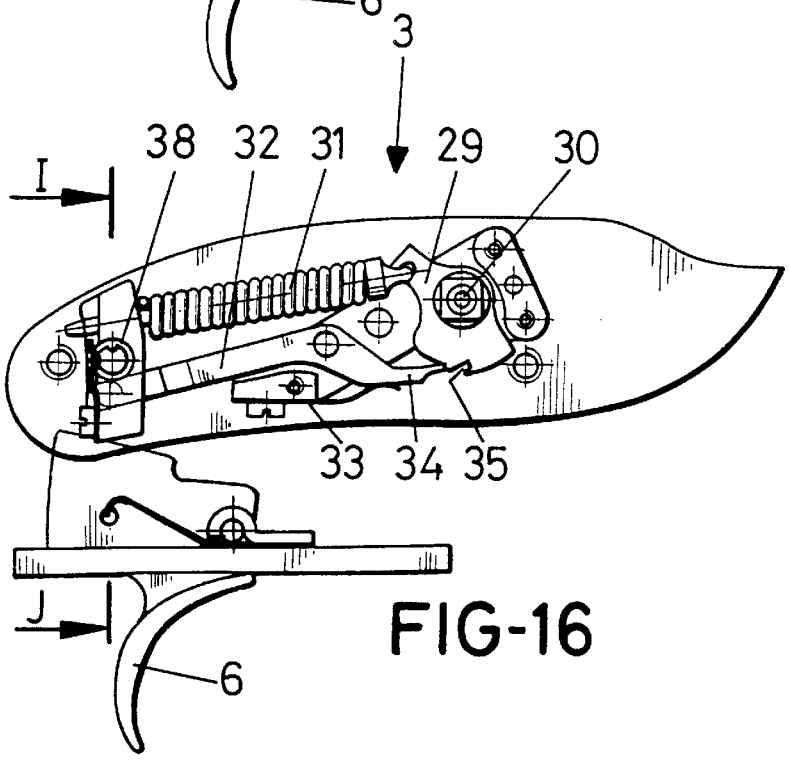
Figure 17:
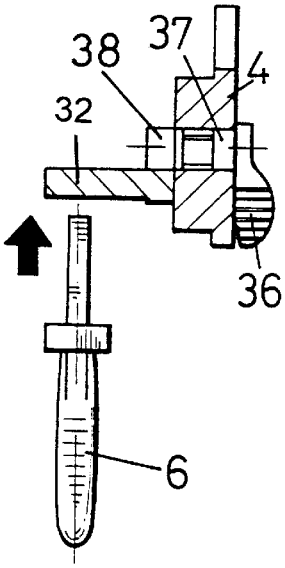
FIG. 17.—Is a cross-sectional close view of the firing and safety system at the additional safety and along line I–J of FIG. 16, in the same operating position as said figure.

Now then, based on this conventional structure for the firing and safety mechanism, in accordance with the invention, the rifle is fitted with an additional safety, comprising a rib or lever (36) fitted to the plate (4), pivoting about a shaft (37), and leading at its inner end into a seimcylinder (38), and therefore when the end (34) of the safety (32) becomes disengaged fron the cmn (29) and leaves the safety position, it lies on said semicylinder (38), as shown in FIGS. 15 and 16, the firearm being thereby cocked and in a firing position with respect to the conventional safety, albeit in a safety position with respect to this additional safety.

Figure 18:
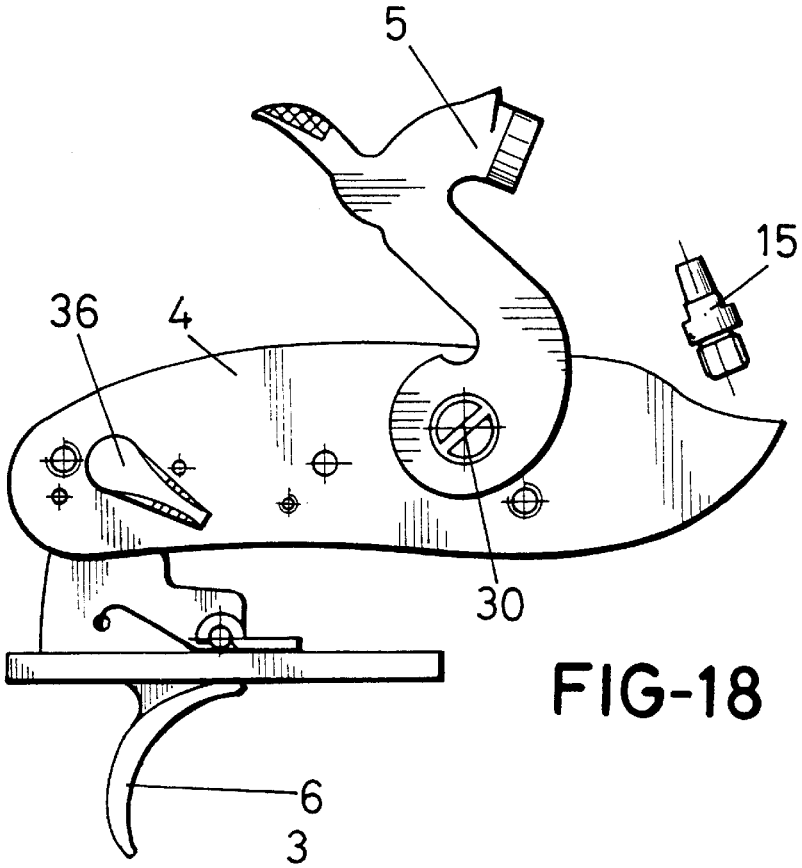
FIGS. 18, 19 and 20.—Match FIGS. 15, 16 and 17 identically, albeit in the "cocked without safety" position of the firearm.
Figure 19:
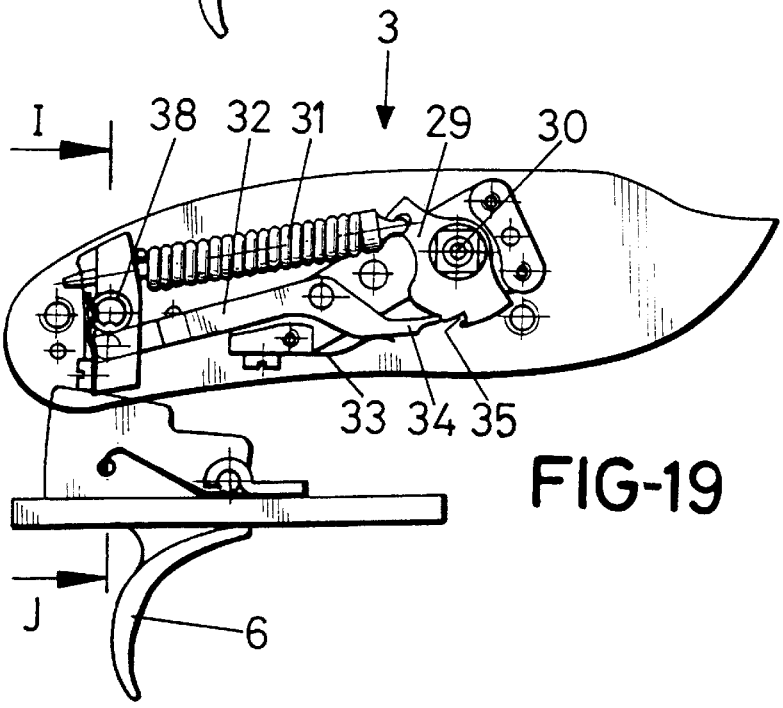
Figure 20:
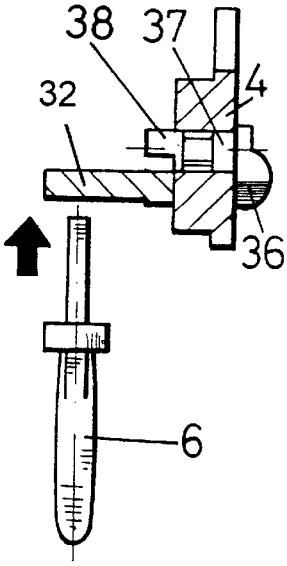
Figure 21:
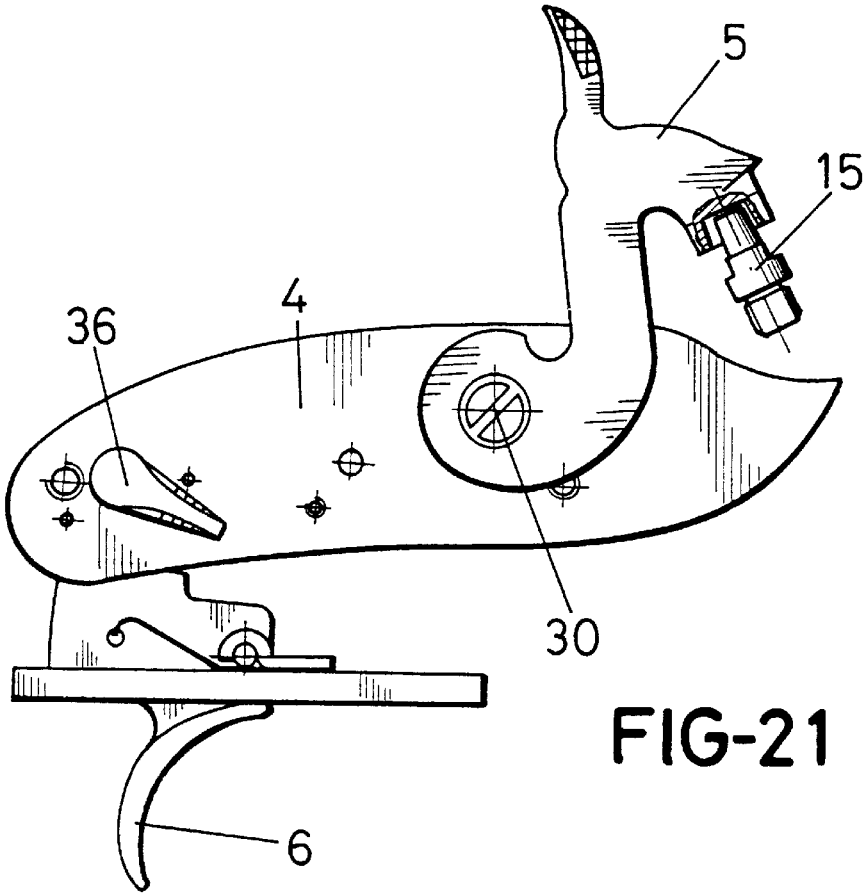
FIGS. 21 and 22.—In turn match FIGS. 18 and 19, albeit in the "fired" position.
Figure 22:
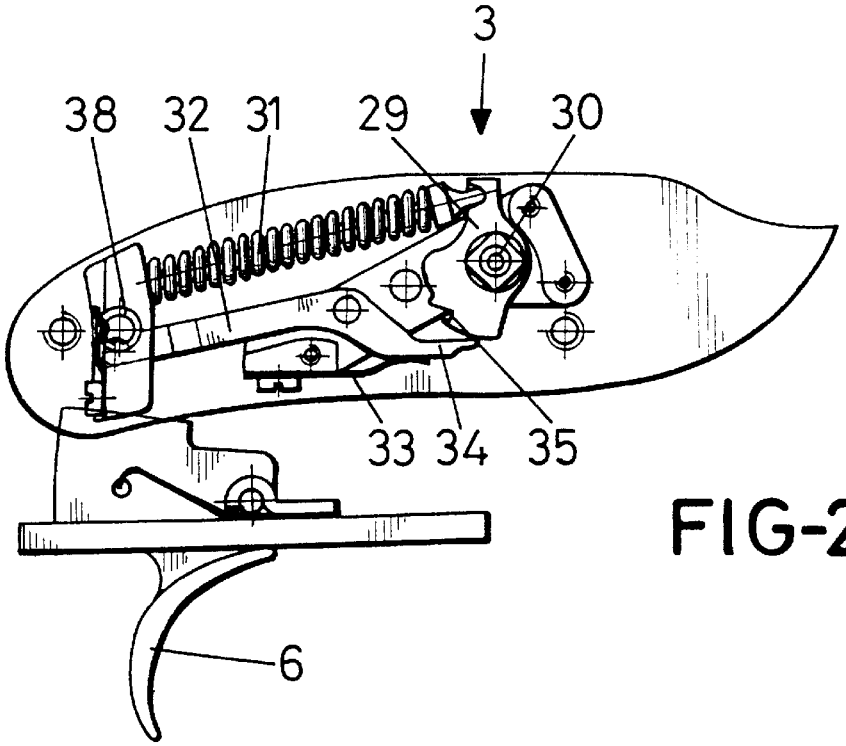
Figure 23:
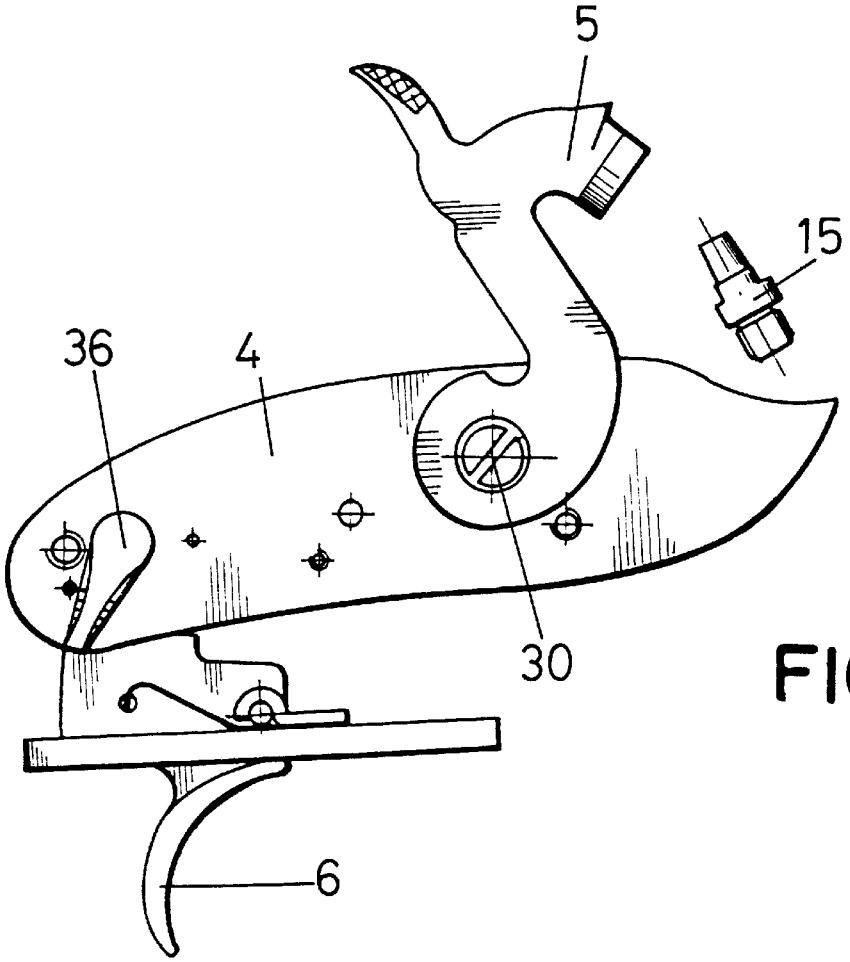
FIGS. 23, 24, 25, 26, 27, 28, 29, 30, 31 and 32.—Respectively match the structures and positions of FIGS. 13, 14, 15, 16, 17, 18, 19, 20, 21 and 22, albeit in an embodiment in which the firing mechanism cam works with a small part or mobile cog actuated by the safety.
Figure 24:
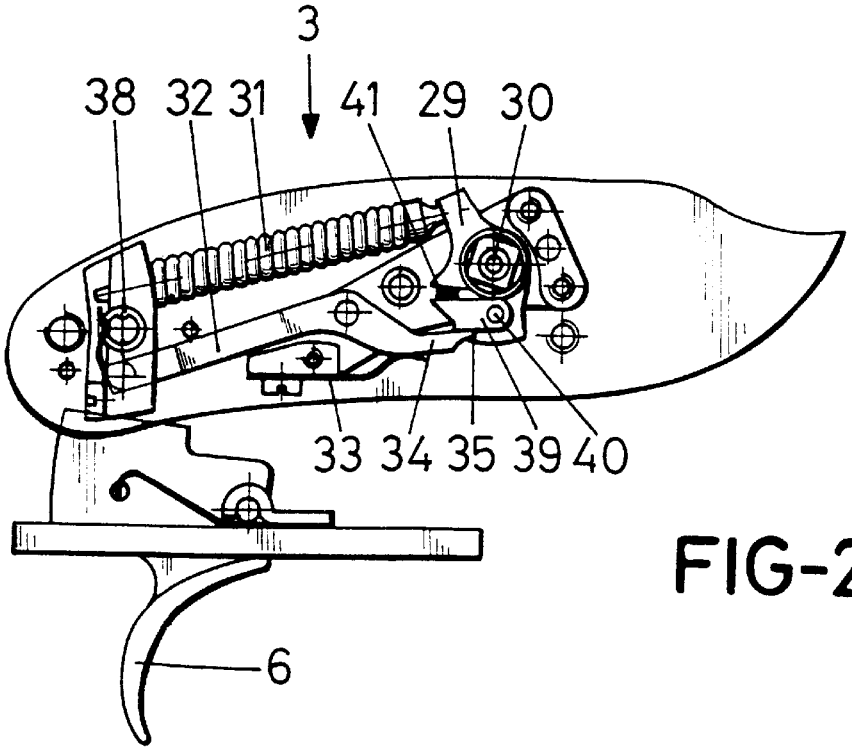
Figure 25:
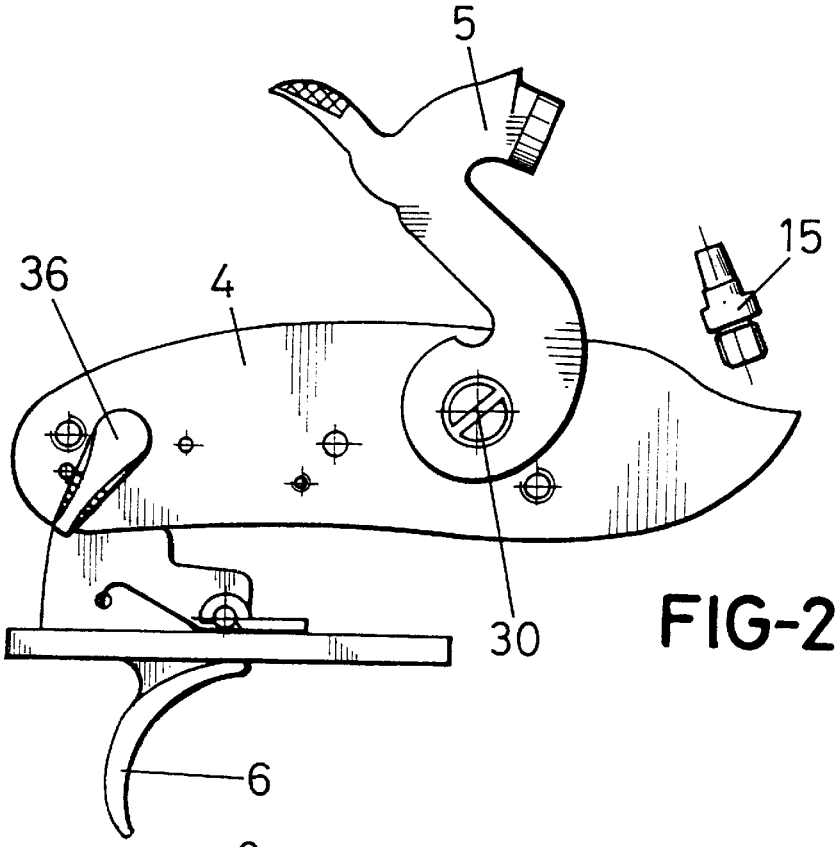
Figure 26:
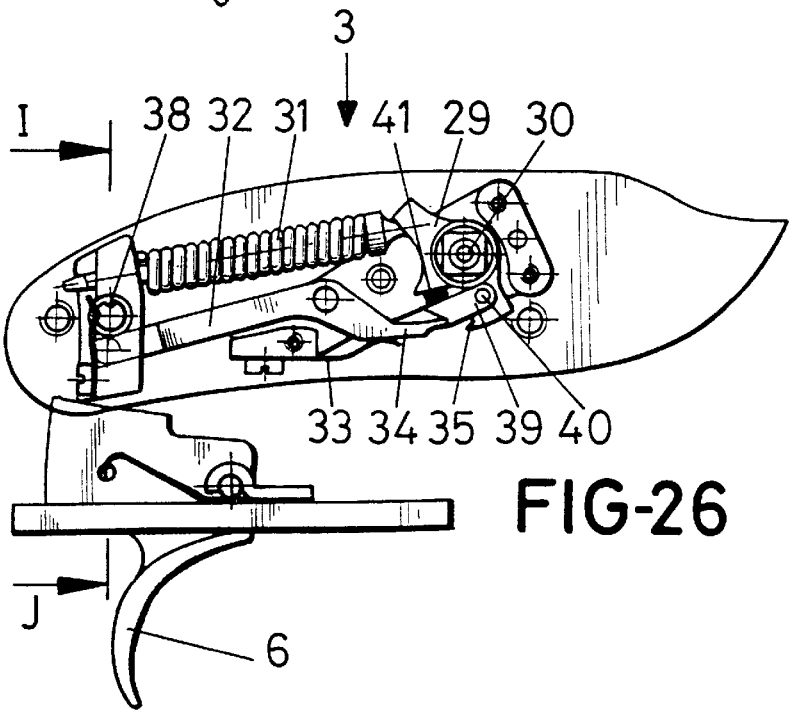
Figure 27:
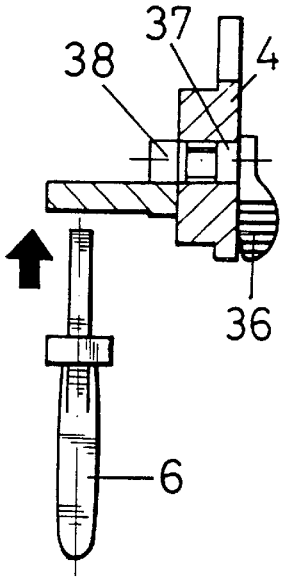
Figure 28:
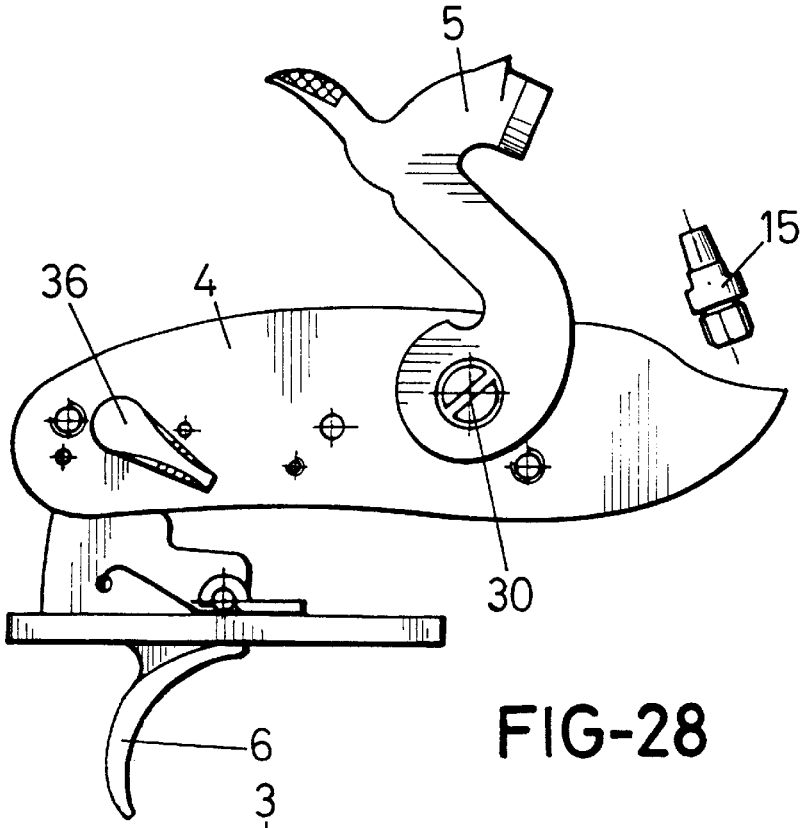
Figure 29:
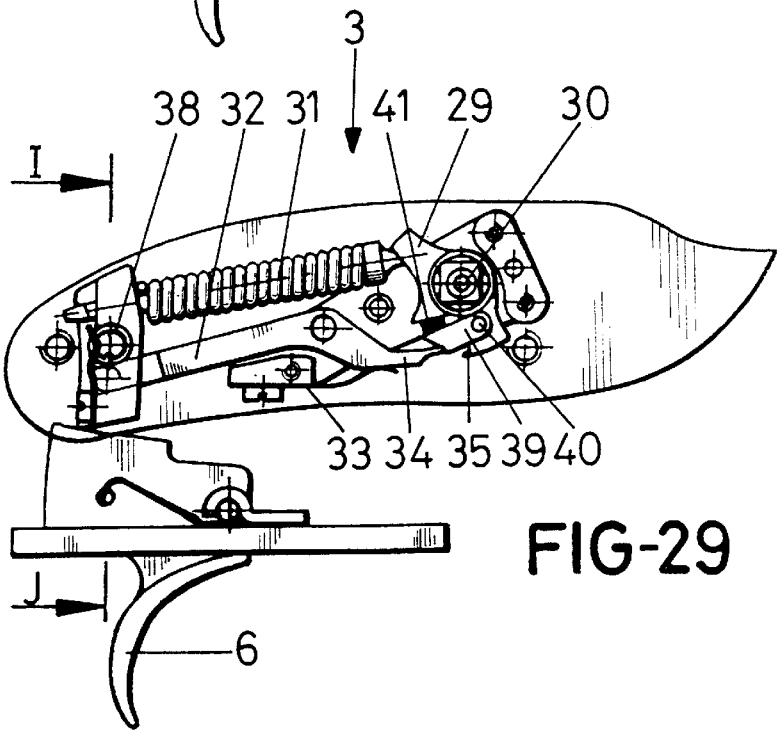
Figure 30:
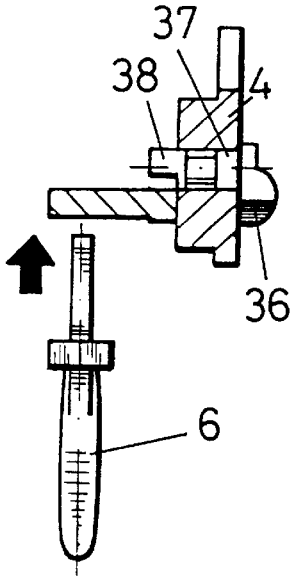
Figure 31:
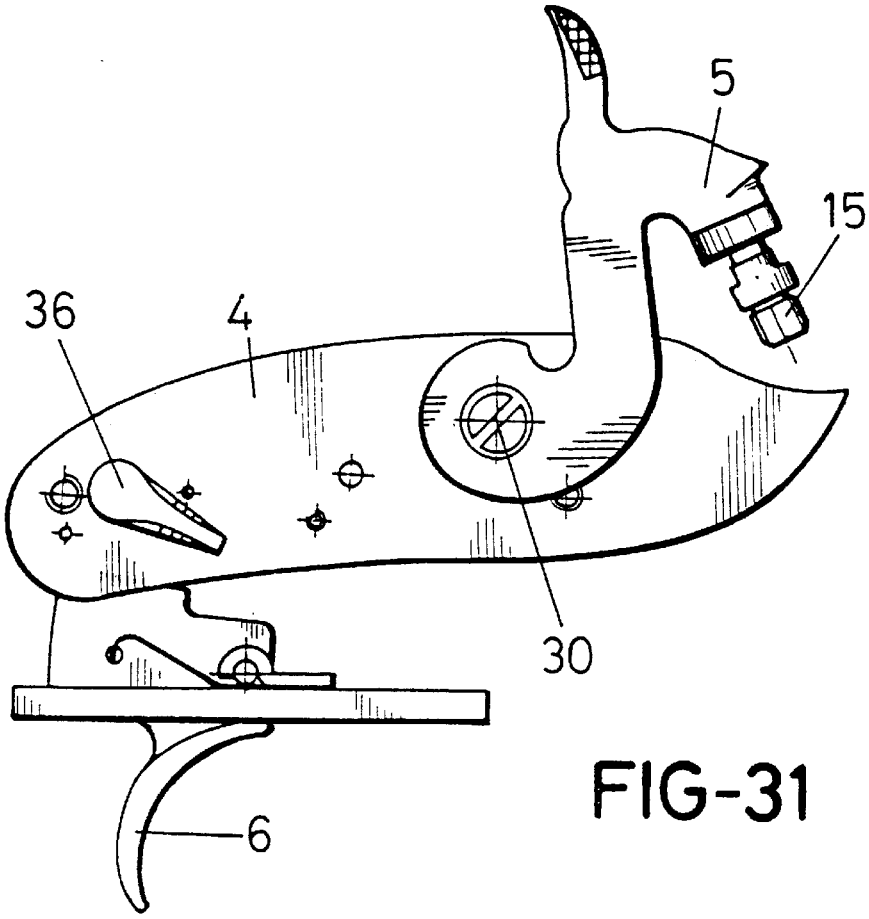
Figure 32:
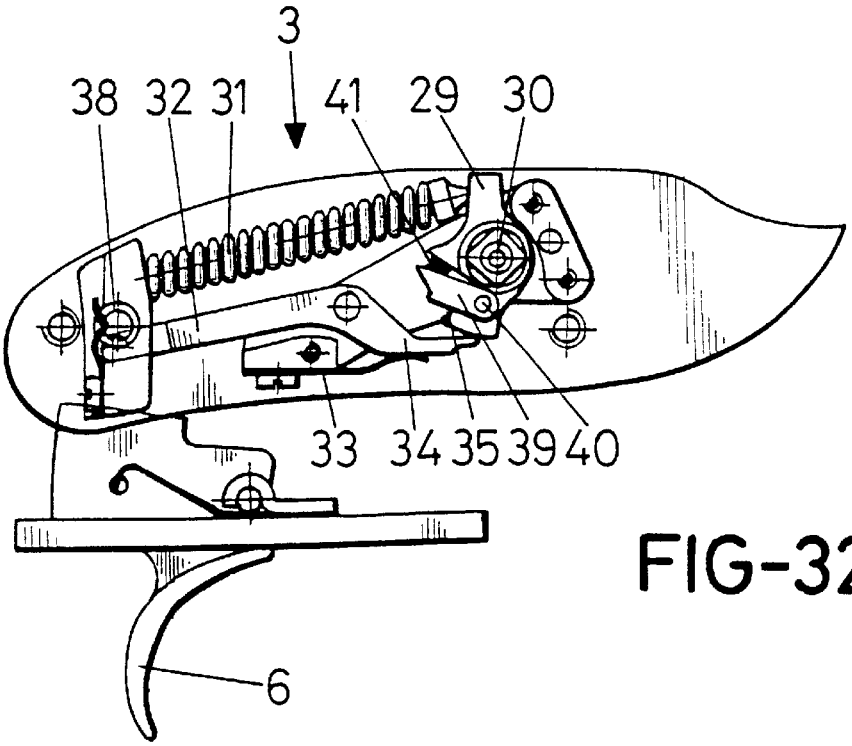

When the lever (36) pivots towards the other position, shown in FIGS. 18, 19 and 20, the rear end of the safety (32) no longer lies on the semicylindrical sector (38) of tihe shaft (37), facing the empty area of said semicylinder (38), the rifle being therefore cocked without a safety, i.e. upon pulling the firearm trigger (6), the end of the safety (32) will be pushed up and its end (34) will therefore no longer brake the cam (29), causing the same to pivot and consequently the hammer (5) to fall upon being pushed by the shuttle (31), whereupon the assembly will take tip the firing position shown in FIGS. 21 and 22.

In order to improve the interconnection between the conventional safety and the additional safety subject of the invention, a mobile cog (39) is provided to be fitted on the cam (29), as shown in FIGS. 23 to 32, pivoting on a shaft (40) and controlled by a small spring (41), and the safety (32) may thus take up the safety position of the cam (29) and simultaneously the auxiliary safety position through the lever (36).

In these conditions, if the hammer (5) is cocked in the firing position, without the lever (36) safety being released, the mobile cog (39) retracts to allow the safety (32) through. Upon the firing position being surpassed, the cog (39) driven by the spring (41) assisting it, lies in die cocked position, the cam (29) being cocked in the firing position.

What is claimed is:

1. A muzzle-loading rifle having a side nipple assembly, a trigger and takedown breech, said rifle comprising:

a stock, a barrel and a breech which are coaxially mounted on the stock and may be taken down in order to be cleaned, a firing and safety mechanism comprising a hammer, a cam, a shuttle, a safety and a safety spring all connected to a plate, said safety having a front end and a rear end, said hammer mounted on said cam and driven by said shuttle upon firing, which cam is engaged by said safety, said safety spring holding said safety in a safety position or in a firing position with respect to said cam, said firing and safety mechanism fiurther comprising a pivoting lever pivotable between a first position and a second position, said pivoting lever being mounted on the plate and attached to a shaft, said shaft having an inner end that leads into a semicylinder overlying the safety, said semicylinder having a flat portion and a rounded portion, wherein when said pivoting lever is in said first position, the safety is in a safety position with respect to said cam, the rear end of the safety abuts on the semicylinder and the front end of the safety is prevented from disengagement with said cam, and wherein when said pivoting lever is in said second position, the flat portion of the semicylinder faces the safety, the safety is in a firing position with respect to said cam, and said safety is disengageable from said cam upon pulling the trigger, such that both the cam and the hammer may fall pushed by the shuttle, and wherein said hammer is capable of being cocked prior to pulling the trigger only when said pivoting lever is in said secon d position due to an upward movement of said rear end of said safety to ward said semicylinder during cocking of said hammer.

2. A muzzle-loading rifle as in claim 1, wherein the cam is fitted with a small cog pivoting on a cog shaft and biased by a cog spring, and wherein upon cocking of said hammer in preparation for firing said rifle, said front end of said safety moves from said cam to said cog, said cog preventing said rear end of said safety from impacting said semicylinder, so that said hammer is capable of being cocked when said pivoting lever is in said first position or said second position.

3. A muzzle-loading rifle having a side nipple assembly and takedown breech, said rifle comprising:

a stock, a barrel and a breech which are coaxially mounted on the stock and may be taken down in order to be cleaned, a firing and safety mechanism comprising a hammer, a cam, a shuttle, a safety and a safety spring, said hammer mounted on said cam and driven by said shuttle upon firing, which cam is engaged by said safety, said safety spring holding said safety in a safety position or in a firing position with respect to said cam, a tubular casing having a first threaded sector for the breech and a second threaded sector for the barrel, said breech and said barrel being respectively threadingly engaged with said sectors, and a throttling provided between said first and second threaded sectors at which the side nipple assembly is positioned, said side nipple assembly having a nipple, wherein the nipple of said nipple assembly is laterally arranged with respect to the barrel for receiving the hammer, the hammer is also laterally arranged with respect to the barrel.

4. A muzzle-loading rifle as in claim 3, wherein said throttling is made of the same material as the casing.

5. A muzzle-loading rifle as in claim 4, wherein said casing has a hollow interior, and wherein said throttling further comprises a lateral bore in which the nipple is housed, said lateral bore extending into another bore that opens radially into the hollow interior of the casing, said another bore being externally closed by a plug.

6. A muzzle-loading rifle as in claim 3, wherein said throttling is defined by a washer disposed between the first and second threaded sectors.

7. A muzzle-loading rifle as in claim 6, wherein said casing further comprises a lateral bore to which the nipple is coupled and which leads into a radial slot in the washer.

8. A muzzle-loading rifle as in claim 3, further comprising a rear shank having a bore and a rearward extension having a bore, wherein the casing is coupled to the rear shank through the breech projecting from the casing, said shank bore having a shape and size that matches the projecting breech, and wherein said rearward extension is designed to be secured to the stock by a screw extending through said rearward extension bore, and wherein said stock has a front end and a fastener is provided to fix the barrel to the front end of the stock.

9. A muzzle-loading rifle having a side nipple assembly, a trigger and takedown breech, said rifle comprising:

a stock, a barrel and a breech which are coaxially mounted on the stock and may be taken down in order to be cleaned, a firing and safety mechanism comprising a hammer, a cam, a shuttle, a safety and a safety spring all connected to a plate, said safety having a front end and a rear end, said hammer mounted on said cam and driven by said shuttle upon firing, which cam is engaged by said safety, said safety spring holding said safety in a safety position or in a firing position with respect to said cam, a tubular casing having a first threaded sector for the breech and a second threaded sector for the barrel, said breech and said barrel being respectively threadingly engaged with said sectors, a throttling provided between said first and second threaded sectors at which the side nipple assembly is positioned, said side nipple assembly having a nipple, wherein the nipple of said nipple assembly is laterally arranged with respect to the barrel for receiving the hammer, the hammer is also laterally arranged with respect to the barrel, said firing and safety mechanism further comprising a pivoting lever pivotable between a first position and a second position, said pivoting lever being mounted on the plate and attached to a shaft, said shaft having an inner end that leads into a semicylinder overlying the safety, said semicylinder having a flat portion and a rounded portion, wherein when said pivoting lever is in said first position, the safety is in a safety position with respect to said cam, the rear end of the safety abuts the semicylinder and the front end of the safety is prevented from disengagement with said cam, and wherein when said pivoting lever is in said second position, the flat portion of the semicylinder faces the safety, the safety is in a firing position with respect to said cam, and said safety is disengageable from said cam upon pulling the trigger, such that both the cam and the hammer may fall pushed by the shuttle, and wherein said hammer is capable of being cocked prior to pulling the trigger only when said pivoting lever is in said second position due to an upward movement of said rear end of said safety toward said semicylinder during cocking of said hammer.

10. A muzzle-loading rifle as in claim 9, wherein said throttling is made of the same material as the casing.

11. A muzzle-loading rifle as in claim 10, wherein said casing has a hollow interior, and wherein said throttling further comprises a lateral bore in which the nipple is housed, said lateral bore extending into another bore that opens radially into the hollow interior of the casing, said another bore being externally closed by a plug.

12. A muzzle-loading rifle as in claim 9, wherein said throttling is defined by a washer disposed between the first and second threaded sectors.

13. A muzzle-loading rifle as in claim 12, wherein said casing further comprises a lateral bore to which the nipple is coupled and which leads into a radial slot in the washer.

14. A muzzle-loading rifle as in claim 9, further comprising a rear shank having a bore and a rearward extension having a bore, wherein the casing is coupled to the rear shank through the breech projecting from the casing, which shank bore has a shape and size that matches the projecting breech, and wherein said rearward extension is designed to be secured to the firearm stock by a screw extending through said rearward extension bore, and wherein said stock has a front end and a fastener is provided to fix the barrel to the front end of the stock.

15. A muzzle-loading rifle as in claim 9, wherein the cam is fitted with a small cog pivoting on a cog shaft and biased by a cog spring, and wherein upon cocking of said hammer in preparation for firing said rifle, said front end of said safety moves from said cam to said cog, said cog preventing said rear end of said safety from impacting said semicylinder, so that said hammer is capable of being cocked when said pivoting lever is in said first position or said second position.

* * * * *